United States Patent [19]

Burton

[11] 4,036,621

[45] July 19, 1977

[54] BEVERAGE DISPENSERS

[75] Inventor: Paul F. Burton, Charles Town, W. Va.

[73] Assignee: Dixie-Narco, Inc., Ranson, W. Va.

[21] Appl. No.: 712,214

[22] Filed: Aug. 6, 1976

[51] Int. Cl.[2] ..... F25D 17/02; B67D 5/62; F28F 1/10

[52] U.S. Cl. ..... 62/394; 62/434; 62/435; 165/172

[58] Field of Search ..... 62/394, 435, 392, 434, 62/436; 165/181, 172; 222/146 C

[56] References Cited

U.S. PATENT DOCUMENTS

| | | | |
|---|---|---|---|
| 1,767,652 | 6/1930 | Daley | 165/172 |
| 2,023,069 | 12/1935 | Fugle | 62/435 |
| 2,119,864 | 6/1938 | Kleucken | 62/394 |
| 2,347,957 | 5/1944 | McCullough | 165/172 |
| 2,418,994 | 4/1947 | Taylor | 62/394 |
| 2,538,015 | 1/1951 | Kleist | 62/434 |
| 2,571,923 | 10/1951 | Morrison | 62/434 |
| 2,653,014 | 9/1953 | Snaider | 62/394 |
| 3,534,814 | 10/1970 | Renzi | 165/172 |
| 3,672,183 | 6/1972 | Bernstein | 62/436 |

*Primary Examiner*—Lloyd L. King
*Attorney, Agent, or Firm*—Bacon & Thomas

[57] ABSTRACT

The evaporator coil of an ice bank type of beverage cooler and dispenser is provided with a multiplicity of spaced apart copper rods extending both inwardly and outwardly of the coil. The evaporator is operated in a tank of water to form a body of ice on the coil and a beverage conduit is cooled by the water. The water gives up its heat in melting the ice. The rods cause the body of ice to have separate and spaced projections of ice extending therefrom to present more surface to the water for more efficient cooling, particularly during peak loads.

3 Claims, 2 Drawing Figures

BEVERAGE DISPENSERS

BACKGROUND OF THE INVENTION

This invention is in the field of beverage dispensing apparatus embodying cooling means.

It has been known in the beverage dispensing art to provide an insulated container of water through which coils for conducting the beverages extend. The beverages are supplied to the coil from a suitable source and withdrawn therefrom at a dispensing station. Such apparatus are also provided with refrigerating systems including a refrigerant evaporator coil immersed in the body of water in the tank referred to. It has also been customary to operate such apparatus by causing the evaporator coil to form a body of ice on itself, which ice is exposed to the water in the tank and in fact formed therefrom. The purpose of the ice bank is to permit use of a relatively small compressor to build ice during slow periods and draw upon it during heavy draw periods. As the water absorbs heat from the beverage to be cooled, it melts ice from the body of ice formed on the evaporator coil to remove from the water the heat absorbed from the beverage. Such dispensers and coolers will be referred to as being of the "ice bank" type. However, when operated at heavy peak loads, particularly where a plurality of different beverage coils are in the tank, the ice does not present a sufficently large surface area to the water to effect efficient cooling of the beverage. In an effort to overcome such shortcomings it has been proposed to increase the capacity of the refrigerating system, thus increasing the cost and energy consumption, thereof to provide a larger body of ice but even such larger bodies of ice would have smooth outer surfaces and only a slightly increased cooling capacity.

SUMMARY OF THE INVENTION

The present invention is directed to an ice bank type of beverage cooler as referred to above but wherein the body of ice formed about the evaporator coil is caused to assume a shape having a multiplicity of projections rather than a smooth surface to thus present a much greater surface area exposed to the water and enhance and facilitate melting of the ice and cooling of the water even a peak loads.

It is, therefore, a principal object of this invention to provide an improved ice bank type of beverage cooler.

Another object is to provide such an improved beverage cooler employing a refrigerating system of modest capacity.

It is a still further object of the invention to provide a beverage cooler achieving the foregoing objects and which is inexpensive to construct and economical and reliable in operation.

DESCRIPTION OF A PREFERRED EMBODIMENT

Figure 1:
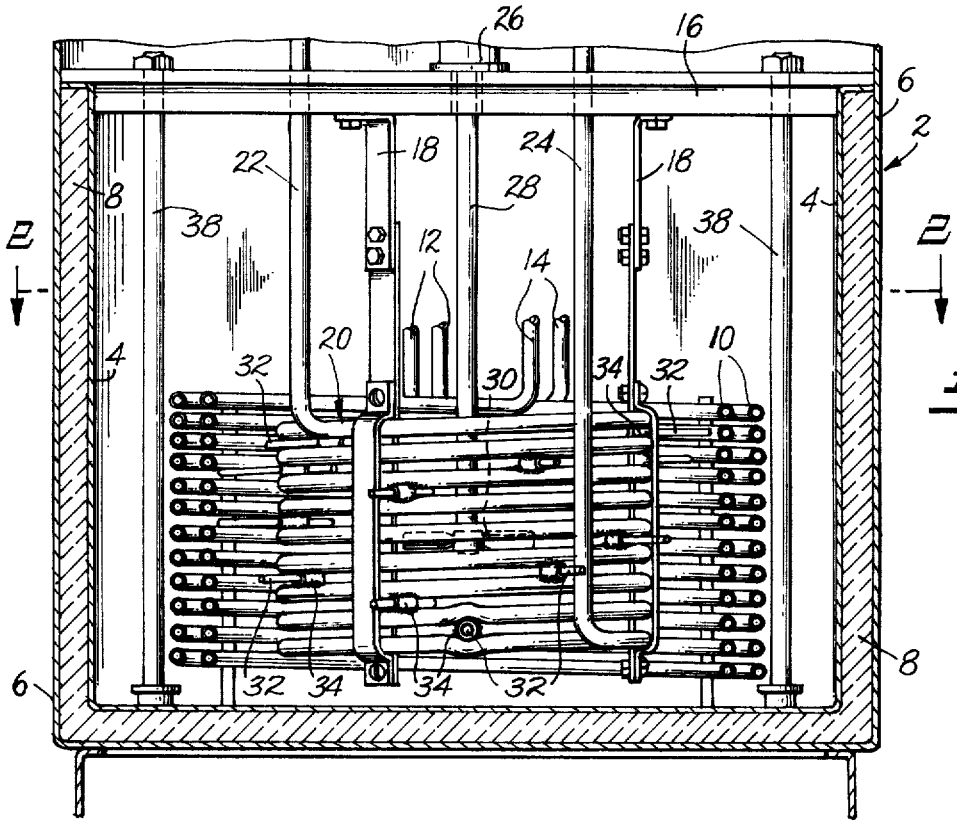
FIG. 1 is a fragmentary vertical sectional view taken on the staggered line 1—1 of FIG. 2.

In the drawings numeral 2 designates an insulated tank or container having inner and outer walls 4 and 6 between which a body of thermal insulating material 8 is positioned. The insulated tank is customarily positioned within a suitable dispensing cabinet of any suitable type. A plurality of helical coils 10 are positioned within the tank and each is provided with an inlet conduit 12 and an outlet conduit 14. The inlet conduits 12 will be connected to suitable sources of beverage which flow through the coils 10 to the outlets 14 to suitable taps or faucets or other dispensing devices forming a part of the cabinet. While only two coils 10 are shown herein, it is to be understood that the apparatus may be provided with a multiplicity of such coils for cooling and dispensing different beverages or different components to be mixed at the dispensing station to constitute a desired beverage.

A cover member 16 for the tank 2 is provided with brackets 18 depending downwardly into the tank and which engage and support an evaporator coil 20. The coil 20 is shown as a helical coil of generally cylindrical shape having an inlet conduit 22 and an outlet conduit 24 extending upwardly through cover plate 16.

While not shown herein it is intended that a suitable compressor and condensor arrangement be mounted on the cover plate 16 and connected to the evaporator coil inlet and outlet conduits in the usual and conventional manner. Also mounted on the cover plate 16 is a motor 26 having a depending shaft 28 on which a circulating impeller 30 is mounted generally centrally of the evaporator coil 20. In operation, the tank 2 will contain a body of water of sufficient depth to cover all of the coils therein and refrigerant expanding in coil 20 will cool the water on which the beverage coil is immersed and thus cool the beverages shown therein. Actually, a body of ice will form on the coil 20 and the melting of the ice constitutes the mechanism by which heat is absorbed from the water.

As previously pointed out, during peak loads when a large quantity of beverage is being withdrawn, the body of ice would not normally melt fast enough to maintain the water at the desired low temperature. This has been found to be due to the fact that the body of ice has a limited surface area exposed to the water and it is only at the surface of those exposed areas that melting takes place.

The present invention constitutes an improvement of the device as thus far described which may be considered conventional. The improvement comprises mounting a multiplicity of heat conductive rods 32 in heat conductive contact with the coil 20 at relatively widely spaced positions. As shown in the drawings, metal sleeves 34 are positioned to extend between turns of the coil 20 and solid rods 32 extend therethrough. The rods are soldered to the tubes 34 and the tubes 34 in turn are soldered to the coil 20. It is contemplated that the tubing of coil 20, the tubular elements 34 and rod 32 all be made of copper but any other suitable heat conductive materials may be employed. The tubes 34 provide for an unusually large area of contact between the turns of coils 20 for rapid heat transfer but it is to be understood that the tubular elements 34 could be omitted and the rods 32 secured in intimate heat conductive contact directly with the turns of coil 20.

Figure 2:
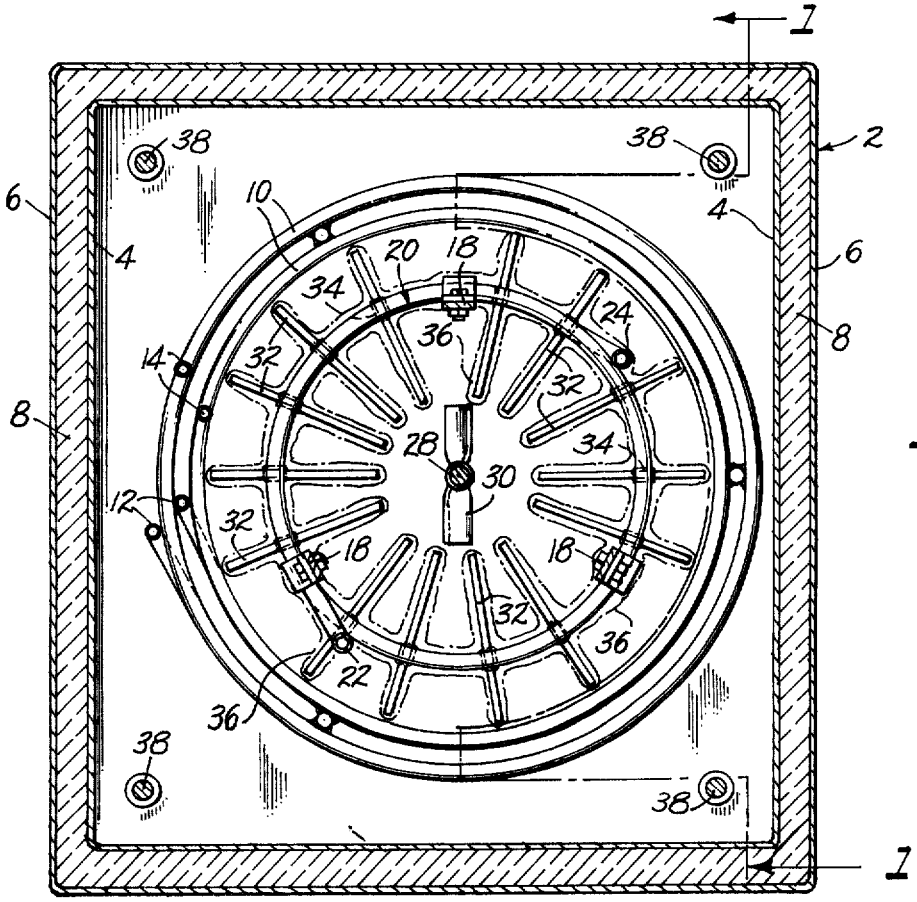
FIG. 2 is a horizontal sectional view taken on the line 2—2 of FIG. 1.

As best seen in FIG. 2, the rods 32 extend generally radially of the evaporator coil and both outwardly and inwardly therefrom. At their outer ends the rods 32 are adjacent the beverage coils 10 and at their inner ends are adjacent the circle generated by the tips of the impeller 30. Those rods 32 above and below the impeller 30 could be made to extend inwardly closer to the axis of shaft 28. In broken lines 36 in FIG. 2 applicant has depicted the ice as formed on the evaporator coil 20 and the rods 32 and showing that the ice on each rod is separate and spaced from the ice on adjacent rods. Obviously, the ice thus formed presents an extremely large surface to the water in tank 2 and will facilitate melting of the ice and cooling of the water at a very rapid rate when necessary. Thus, there will be no substantial lag during peak loads between the withdrawing of beverage and melting of sufficient ice to maintain the water at the desired low temperature. The melting of the ice by the water is, of course, facilitated by the circulation of the water in the tank as induced by operation of the impeller 30 which maintains a constant movement of water over the surface of the ice on both the evaporator coil 20 and the rods 32.

As shown, the cover plate 16 rests loosely on the tank 2 so that it, the mechanisms mounted on it and coil 20 may be lifted from the tank for service or repair, or for other purposes. The legs 38, secured to cover 16, support the assembly, when removed from the tank, for easy access to the parts thereof.

Applicant is well aware that heat exchanger tubes have been provided with fins or the like or even spikes U.S. Pat. No. 2,200,502) to facilitate heat transfer between the tubes and a fluid medium. If such known devices were used in applicant's environment, they would merely serve to make a larger body of smooth surfaced ice. The purpose of this invention is not to facilitate heat transfer between the coil 20 and the water, that has been no problem even with smooth coils. Applicant's purpose is to alter the shape of ice formed in the tank so as to present a greater area to the surrounding liquid water.

While a single specific embodiment of the invention has been shown and described herein, the same is merely illustrative of the principles involved and other forms may be resorted to within the scope of the appended claims.

I claim:

1. In a beverage dispenser and cooler having a cooling tank for holding a body of water, a beverage circulating coil in said tank and a refrigerant evaporator coil in said tank for freezing water therein to effect cooling of a beverage in said beverage circulating coil; the improvement comprising:

heat conductive projections secured to and extending away from said evaporator coil and spaced apart sufficiently to form separate ice projections from the body of ice formed on said evaporator coil and thereby increase the ice surface exposed to water in said tank, said evaporator coil being a helical coil of generally cylindrical form, said projections comprising metal rods extending generally radially of said evaporator coil, between the turns thereof, and being secured in heat conducting relation thereto.

2. A dispenser as defined in claim 1 wherein said metal rods extend generally radially outwardly and inwardly of said coil.

3. A dispenser as defined in claim 1 including a water circulating impeller located centrally within said coil, said metal rods being secured to said evaporator coil and extending inwardly thereof generally toward but spaced from said impeller.

* * * * *